US012415246B2

(12) United States Patent
Hsieh

(10) Patent No.: US 12,415,246 B2
(45) Date of Patent: Sep. 16, 2025

(54) PROTECTIVE COVER ASSEMBLED ON ABRASIVE BELT HAND TOOL

(71) Applicant: DIN LONG INDUSTRIAL CO., LTD., Taoyuan (TW)

(72) Inventor: Jung-Fu Hsieh, Taoyuan (TW)

(73) Assignee: DIN LONG INDUSTRIAL CO., LTD., Taoyuan (TW)

( * ) Notice: Subject to any disclaimer, the term of this patent is extended or adjusted under 35 U.S.C. 154(b) by 1392 days.

(21) Appl. No.: 16/878,258

(22) Filed: May 19, 2020

(65) Prior Publication Data

US 2021/0362288 A1 Nov. 25, 2021

(51) Int. Cl.
*B24B 21/18* (2006.01)
*B24B 23/06* (2006.01)

(52) U.S. Cl.
CPC ..... *B24B 21/18* (2013.01); *B24B 23/06* (2013.01)

(58) Field of Classification Search
CPC ..... B24B 55/057; B24B 55/06; B24B 55/052; B24B 21/18; B24B 23/005; B24B 23/06; B24B 23/02; B24B 21/20; B24B 21/00; B24B 23/028; B24B 55/05; B24B 27/08
USPC ..... 451/355, 451, 452
See application file for complete search history.

(56) References Cited

U.S. PATENT DOCUMENTS 4,643,460 A * 2/1987 Lieberg ..... F16L 17/04 285/365
5,210,981 A * 5/1993 Urda ..... B24B 23/06 451/296
6,688,955 B2 * 2/2004 Ruey-Zon ..... B24B 55/052 451/451
10,618,139 B2 4/2020 Sun
2007/0298696 A1 * 12/2007 Blatz ..... B24B 55/052 451/451

(Continued)

FOREIGN PATENT DOCUMENTS

CN 208945846 U 6/2019
CN 110216557 A 9/2019

(Continued)

OTHER PUBLICATIONS

Translation of FR-2767734-A3 (Year: 2024).*
Translation of GB-2082487-A (Year: 2024).*

*Primary Examiner* — Monica S Carter
*Assistant Examiner* — Sarah Akyaa Fordjour
(74) *Attorney, Agent, or Firm* — MUNCY, GEISSLER, OLDS & LOWE, P.C.

(57) ABSTRACT

A protective cover assembled on an abrasive belt hand tool. The protective cover comprises an annular base and a tightening component. The annular base comprises a notch, a first clamping arm positioned on one side of the notch, and a second clamping arm positioned on the other side. The first clamping arm is formed with a through hole, the second clamping arm is formed with an assembly hole, the assembly hole does not penetrating through the second clamping arm. The annular base comprises a first state for tightening a protective cover mounting portion when the first clamping arm and the second clamping arm narrow the notch, and the annular base comprises a second state that the first clamping arm and the second clamping arm do not narrow the notch. The tightening component comprises a pull rod penetrating through the through hole and a piece arranged on the pull rod.

4 Claims, 4 Drawing Sheets

(56) References Cited

U.S. PATENT DOCUMENTS

| | | | | |
|---|---|---|---|---|
| 2010/0111595 | A1* | 5/2010 | Lin | B62K 25/02<br>403/322.4 |
| 2018/0093359 | A1* | 4/2018 | Johnson | B24B 47/12 |

FOREIGN PATENT DOCUMENTS

| | | | | |
|---|---|---|---|---|
| FR | 2767734 | A3 * | 3/1999 | B24B 23/06 |
| GB | 2082487 | A * | 3/1982 | B24B 23/06 |

* cited by examiner

PROTECTIVE COVER ASSEMBLED ON ABRASIVE BELT HAND TOOL

FIELD OF THE INVENTION

The invention relates to a protective cover assembled on an abrasive belt hand tool, in particular to a protective cover which enables an annular base to tighten a protective cover mounting portion under the action of a tightening component.

BACKGROUND OF THE INVENTION

In the market, the structures of the abrasive belt machines mostly designed to be implemented with replaceable abrasive belts so that the abrasive belt can be replaced after being used for a long time or the abrasive belt machines can be matched with different abrasive bags according to the requirements, the related structures is referred to patents such as CN 110216557A, U.S. Ser. No. 10/618,139B and CN 208945846U.

According to the drawings illustrated in patents CN 110216557A and U.S. Ser. No. 10/618,139B, it can be found that the conventional abrasive belt machine is provided with a quick-release component on the body of the abrasive belt machine to facilitate the removal of the abrasive belt. However, in the conventional structure, the abrasive belt is mostly arranged on an abrasive belt mounting seat, and the abrasive belt mounting seat is provided with two through holes respectively. The quick-release component penetrates through the two through holes and is provided with an operation piece on one side of the two through holes and a stop block on the other side of the two through holes. When the quick-release structure operated by the piece, the stop block pushes the abrasive belt mounting seat to move towards the direction facing the piece, so that the abrasive belt mounting seat and the body of the abrasive belt machine are tightened, and the abrasive belt is mounted on the body of the abrasive belt machine. When the abrasive belt mounting seat is to be disassembled, the piece is operated again, so that the stop block no longer limits the abrasive belt mounting seat, and the abrasive belt mounting seat is disengaged from the body of the abrasive belt machine. However, in the conventional quick-release structure, it is necessary to pay attention to the assembly directions of the parts during assembly, and thereby the abrasive belt mounting seat cannot be fixed quickly. In addition, according to the patent CN 208945846U, although the abrasive belt mounting seat is assembled through the thread structure, the abrasive belt mounting seat cannot be fixed quickly with this operation manner.

SUMMARY OF THE INVENTION

The main purpose of the present invention is to solve the problem of the conventional structure that must be paid attention to the assembly directions of the parts during assembly and the mounting of the conventional structure is not convenient.

In order to achieve the above object, the present invention provides a protective cover assembled on an abrasive belt hand tool, wherein the protective cover is assembled with a driving component of the abrasive belt hand tool and is provided for an abrasive belt to move therein. The driving component is provided with a driving shaft and a protective cover mounting portion formed at one end of the driving shaft. The protective cover comprises an annular base and a tightening component, and the annular base is arranged on the protective cover mounting portion and provided for the driving shaft to extend into the annular base. The annular base comprises a notch, a first clamping arm positioned on one side of the notch and a second clamping arm positioned on one side of the notch which is not provided with the first clamping arm and facing the first clamping arm. The first clamping arm is formed with a through hole, and the second clamping arm is formed with an assembly hole on a same extension line as the through hole. The assembly hole does not penetrate through the second clamping arm, and the annular base comprises a first state for tightening the protective cover mounting portion when the first clamping arm and the second clamping arm are getting closed, to narrow the notch and a second state for releasing the protective cover mounting portion when the first clamping arm and the second clamping arm do not narrow the notch. The tightening component comprises a pull rod penetrating through the through hole with one end fixed with the assembly hole and a piece arranged at one end of the pull rod, which is not fixed with the assembly hole. The piece moves with respect to a surface of the annular base by taking the pull rod as an axial center to switch the annular base in the first state or the second state.

In one embodiment, the piece comprises a cam portion assembled with the pull rod and moving with respect to a surface of the first clamping arm when the piece is stressed and a shifting portion connected with the cam portion. An assembling position of the piece and the pull rod are deviated from a center of the cam portion.

In one embodiment, the pull rod comprises a coupling section for assembling the piece, a connecting section extending from the coupling section and penetrating through the through hole, and a threading section extending from the connecting section and fixed in the assembly hole. An inner wall of the assembly hole is formed with a thread for assembling the threading section.

In one embodiment, a length of the assembly hole is longer than a length of the through hole.

In one embodiment, the tightening component comprises a gasket sleeved on the pull rod and arranged between the piece and the first clamping arm.

In one embodiment, the protective cover comprises an arc-shaped receiving groove arranged on the first clamping arm and facing the piece.

In one embodiment, the annular base comprises an abrasive belt supporting seat extending from the second clamping arm towards a direction opposite to the annular base.

From the above mention, the invention has the following characteristics compared with prior art: the first clamping arm and the second clamping arm which are respectively positioned on two sides of the notch are formed on the annular base, and the assembly hole formed on the second clamping arm does not penetrate through the second clamping arm, so that the tightening component is fixed in the assembly hole. When implemented, the annular base is forced by the tightening component, so that the first clamping arm and the second clamping arm narrow the notch to tighten the protective cover mounting portion. The present invention provides a protective cover which is different from a conventional one in structure and is convenient for a user to mount the protective cover on the abrasive belt hand tool.

DETAILED DESCRIPTION OF THE PREFERRED EMBODIMENTS

Figure 1:
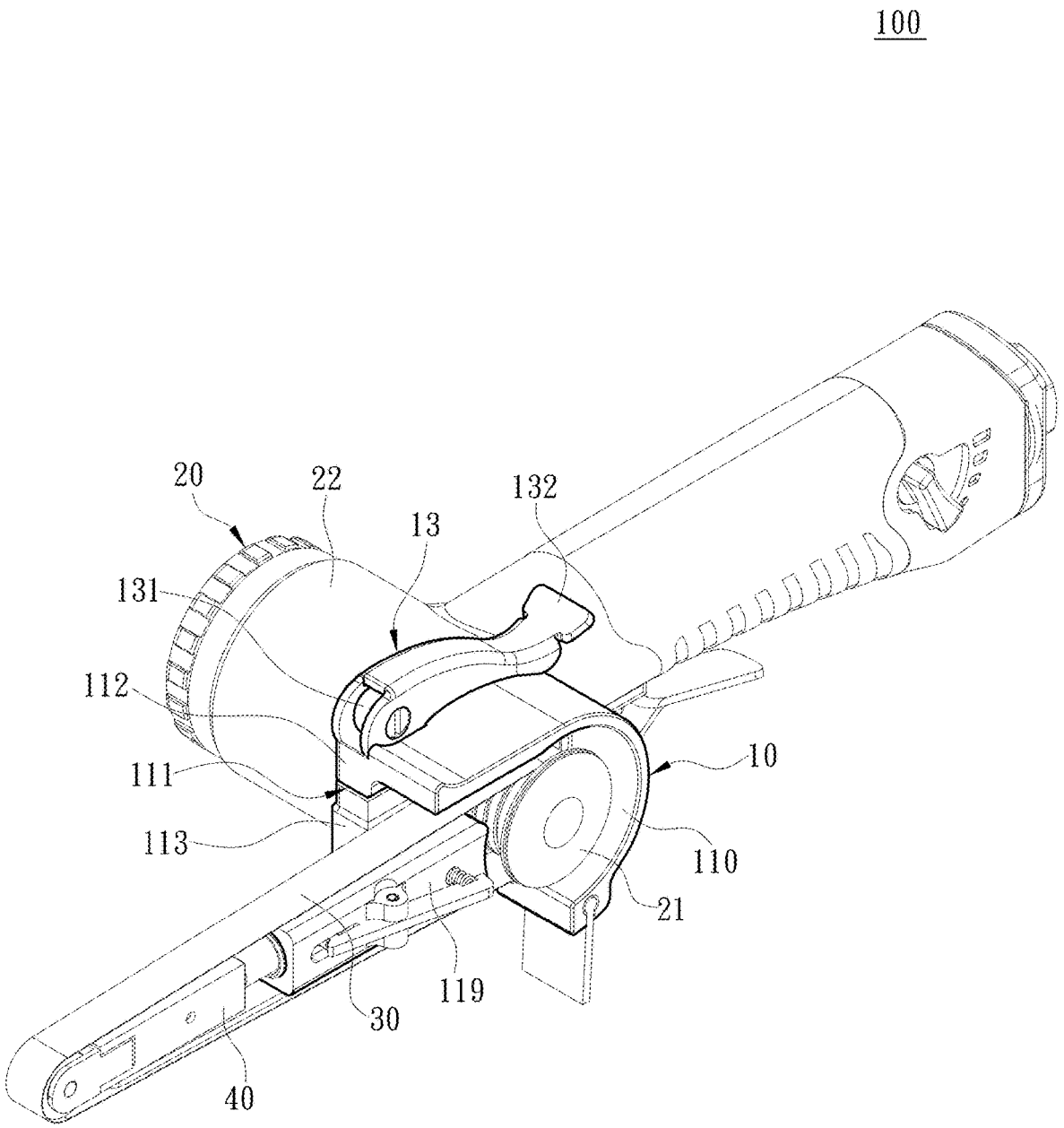
FIG. 1 is a structural schematic view of an embodiment of the present invention assembled with an abrasive belt hand tool.

The detailed description and technical contents of the present invention are described with reference to the drawings as follows:

Referring to FIG. 1, the present invention provides a protective cover 10 assembled with an abrasive belt hand tool 100. A basic structure of the abrasive belt hand tool 100 is described. The abrasive belt hand tool 100 is not limited to a pneumatic hand-held tool machine or an electric hand-held tool machine. The abrasive belt hand tool 100 includes a driving component 20 driven by gas or electricity, and an abrasive belt 30 driven by the driving component 20. The driving component 20 is assembled with the protective cover 10, and the driving component 20 includes a driving shaft 21 for driving the abrasive belt 30 and a protective cover mounting portion 22 formed at one end of the driving shaft 21. The driving shaft 21 penetrates into the protective cover 10 and allows the abrasive belt 30 to be arranged in the protective cover 10, and one side of the protective cover mounting portion 22 is used for assembling the protective cover 10.

Referring to FIG. 1, FIG. 2, FIG. 3 and FIG. 4, the protective cover 10 comprises an annular base 11 and a tightening component 13. Specifically, the annular base 11 is assembled with the protective cover mounting portion 22 and used for the driving shaft 21 to extend in the annular base 11. The annular base 11 includes a notch 111, a first clamping arm 112 positioned on one side of the notch 111, and a second clamping arm 113. The second clamping arm 113 is positioned on one side of the notch 111 which is not provided with the first clamping arm 112 and faces the first clamping arm 112. The first clamping arm 112 is formed with a through hole 114, and the through hole 114 faces and communicates with the notch 111. The second clamping arm 113 is formed with an assembly hole 115, and the assembly hole 115 is positioned on a same extension line as the through hole 114 and also faces the notch 111. The assembly hole 115 does not penetrate through the second clamping arm 113 and communicates with the notch 111 on one side. In one embodiment, a length of the assembly hole 115 is longer than the length of the through hole 114. Further, the annular base 11 is assembled with the tightening component 13, the annular base 11 is in a first state 116 when being forced by the tightening component 13, and the annular base 11 is in a second state 117 without being forced upon by the tightening component 13. In the first state 116, the first clamping arm 112 and the second clamping arm 113 are getting closed to narrow the notch 111; in a second state 117, the first clamping arm 112 and the second clamping arm 113 do not narrow the notch 111. On the other hand, the tightening component 13 comprises a pull rod 131 penetrating through the through hole 114 and a piece 132 connected with the pull rod 131. The pull rod 131 passes through the notch 111 from the through hole 114 to enter the assembly hole 115. One end of the pull rod 131 is fixed in the assembly hole 115, and the other end of the pull rod 131 protrudes out of the through hole 114 to be exposed on the surface of the first clamping arm 112. The piece 132 is arranged on one side of the first clamping arm 112 which does not face the second clamping arm 113, and the piece 132 is connected with one end of the pull rod 131 which is not fixed in the assembly hole 115. The piece 132 is movable with respect to the annular base 11 by taking the pull rod 131 as an axial center, so that the annular base 11 can switch to be in the first state 116 or the second state 117.

Figure 3:
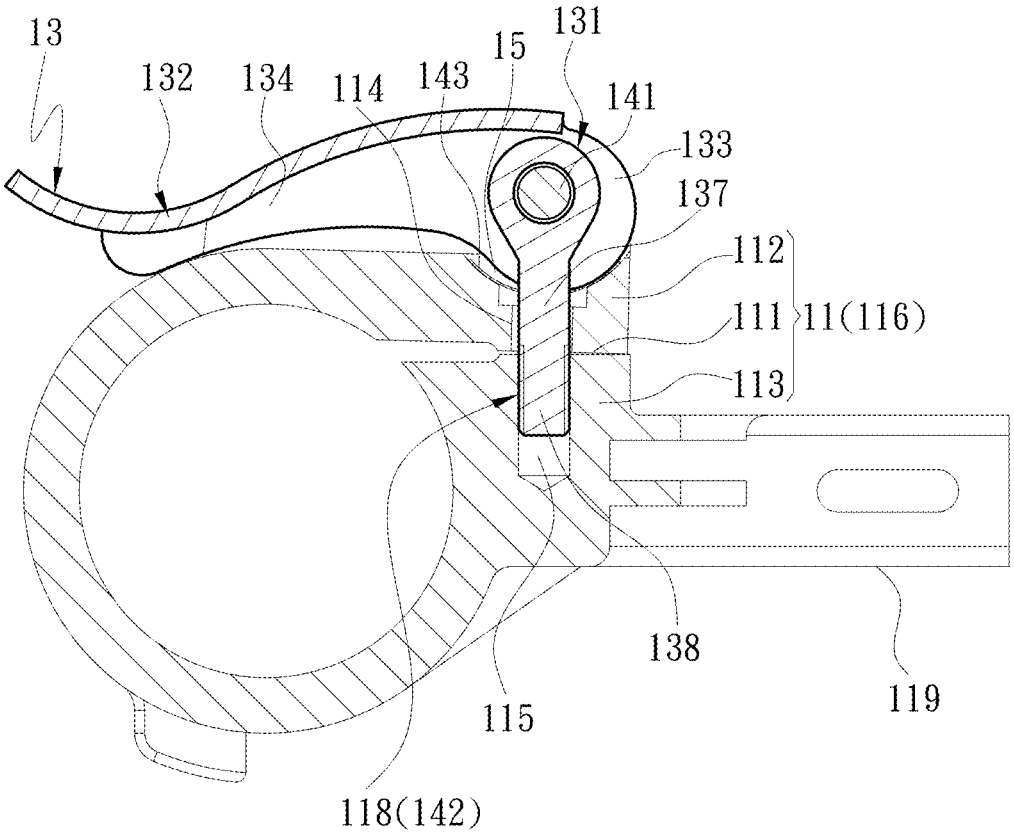
FIG. 3 is a structural cross-sectional schematic view in the first state of an embodiment of the present invention.
Figure 4:
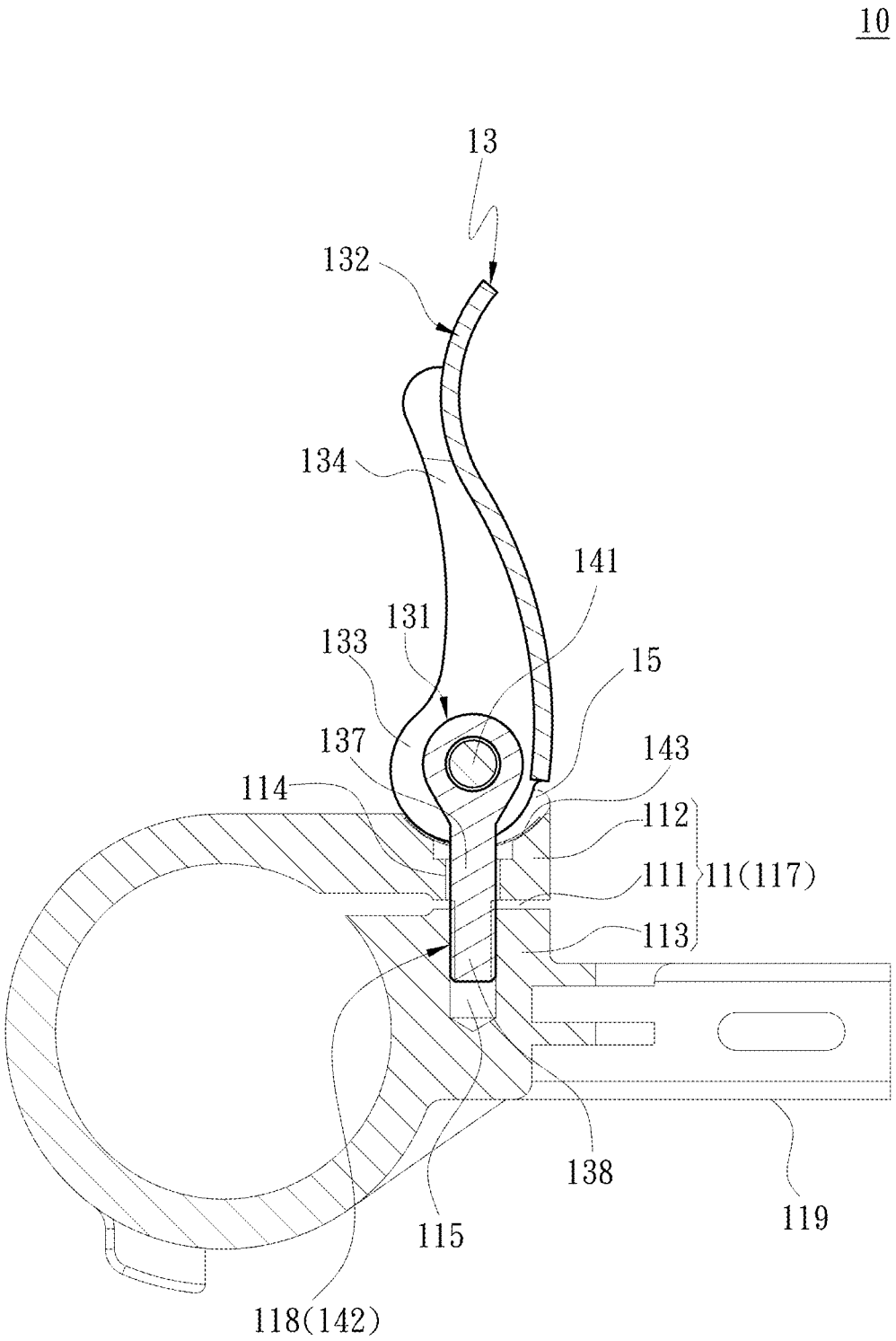
FIG. 4 is a structural cross-sectional schematic view in the second state of an embodiment of the present invention.

With reference to FIG. 3 and FIG. 4, the implementation of the protective cover 10 is described. First, it is assumed that the protective cover 10 is not fixed with the protective cover mounting portion 22 initially, that is, the annular base 11 does not tighten the protective cover mounting portion 22. Please refer to FIG. 3. To fix the protective cover 10 with the protective cover mounting portion 22, the piece 132 presses against the first clamping arm 112 to shift towards the direction of the second clamping arm 113. At the same time, the pull rod 131 is also forced by the piece 132, causing the second clamping arm 113 and the first clamping arm 112 get closed. At this point, the first clamping arm 112 and the second clamping arm 113 narrow the notch 111 so that the annular base 11 is in the first state 116. The annular base 11 is acted upon by the tightening component 13 to tighten the protective cover mounting portion 22, so that the protective cover 10 is fixed with the protective cover mounting portion 22. Further, please refer to FIG. 4. When the piece 132 displaces with respect to the surface of the first clamping arm 112 by taking the pull rod 131 as the axial center, the piece 132 stop pressing against the first clamping arm 112. At the same time, the pull rod 131 is also acted upon by the piece 132, causing the second clamping arm 113 and the first clamping arm 112 stop getting closed, so that the first clamping arm 112 and the second clamping arm 113 back to original position. At this point, the first clamping arm 112 and the second clamping arm 113 stop pressing against the notch 111, causing the annular base 11 to transfer to the second state 117 from the first state 116. Thus, the annular base 11 stop pressing the protective cover mounting portion 22 and allows the protective cover 10 to be disengaged with respect to the protective cover mounting portion 22. Further, if the protective cover 10 is to be fixed with the protective cover mounting portion 22 again, the annular base 11 can press the protective cover mounting portion 22 by merely operating the piece 132 again to transfer the annular base 11 to be in the first state 116 from the second state 117.

Accordingly, the annular base 11 is formed with the first clamping arm 112 and the second clamping arm 113 which are respectively positioned on two sides of the notch 111, and the assembly hole 115 formed on the second clamping arm 113 does not penetrate through the second clamping arm 113, so that the tightening component 13 is fixed in the assembly hole 115. When the annular base 11 is acted upon by the tightening component 13, causing the first clamping arm 112 and the second clamping arm 113 to narrow the notch 111, and thereby the annular base 11 pressing the protective cover mounting portion 22. The present invention provides a protective cover 10 which is different from a conventional structure and is convenient for a user to mount the protective cover 10 on the abrasive belt hand tool 100.

Figure 2:
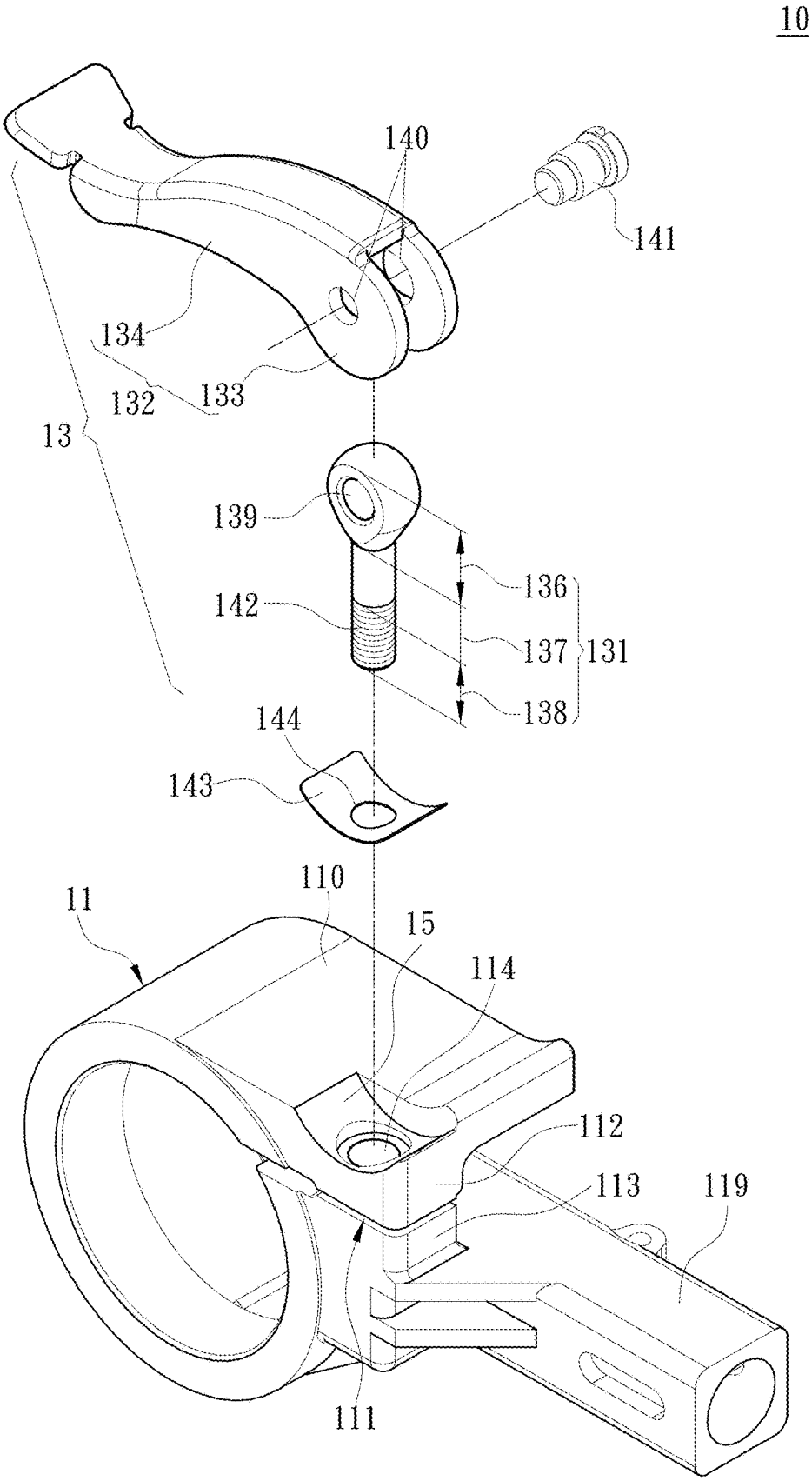
FIG. 2 is a structural exploded schematic view of an embodiment of the present invention.

In one embodiment, referring to FIG. 2, FIG. 3, and FIG. 4, the piece 132 includes a cam portion 133 assembled with the pull rod 131 and a shifting portion 134 connected with the cam portion 133. The cam portion 133 contacts the surface of the first clamping arm 112, and is forced by the piece 132. The cam portion 133 displaces with respect to the surface of the first clamping arm 112 by taking the assembling position of the cam portion 133 and the pull rod 131 as an axial center. Further, the assembling position of the piece 132 and the pull rod 131 is deviated from a center of the cam portion 133. As shown in FIG. 3, the assembling position of the piece 132 and the pull rod 131 is relatively higher than the center of the cam portion 133. The piece 132 is acted upon to displace with respect to the surface of the annular base 11. A distance of the assembling position of the piece 132 and the pull rod 131 from the surface of the annular base 11 will vary. Specifically, a distance of the piece 132 from the surface of the annular base 11 in the first state 116 is greater than the distance of the piece 132 from the surface of the annular base 11 in the second state 117. Thus, when the annular base 11 is in the first state 116, the piece 132 is acted upon by the pull rod 131 to press against the first clamping arm 112, and when the annular base 11 is in the second state 117, the piece 132 allows the first clamping arm 112 to back to the original position. On the other hand, in order to limit the assembling position of the cam portion 133, the protective cover 10 includes an arc-shaped receiving groove 15 arranged on the first clamping arm 112 and facing the piece 132, and the arc-shaped receiving groove 15 is arranged corresponding to the cam portion 133 and is provided for the cam portion 133 to be arranged therein, thereby providing a preliminary limit of the cam portion 133.

In addition, referring to FIG. 2, FIG. 3, and FIG. 4, in one embodiment, the pull rod 131 includes a coupling section 136 assembled with the piece 132, a connecting section 137 extending from the coupling section 136 and penetrating through the through hole 114, and a threading section 138 extending from the connecting section 137 and fixed in the assembly hole 115. Furthermore, the pull rod 131 is assembled with the piece 132. An opening 139 penetrates through the pull rod 131 and forms on the coupling section 136 of the pull rod 131, and the opening 139 faces to two holes 140 of the piece 132. The tightening component 13 comprises an assembly member 141 penetrating into the two holes 140 and the opening 139. The assembly member 141 assembles with the pull rod 131 and the piece 132 to prevent the pull rod 131 from being disengaged from the piece 132. In addition, the pull rod 131 is assembled in the assembly hole 115, and the pull rod 131 is formed with a first thread 142 at the threading section 138. An inner wall of the assembly hole 115 is formed with a second thread 118 corresponding to the first thread 142, so that the threading section 138 is arranged in the assembly hole 115 while the first thread 142 is assembled with the second thread 118.

Accordingly, referring to FIG. 2, the tightening component 13 further comprises a gasket 143 arranged on the pull rod 131, the gasket 143 is formed with an aperture 144 through which the pull rod 131 penetrates. The gasket 143 is provided between the piece 132 and the first clamping arm 112 and corresponds to the through hole 114, and the gasket 143 contacts the cam portion 133 after assembly is completed.

On the other hand, in one embodiment, the annular base 11 includes an abrasive belt supporting seat 119 extending from the second clamping arm 113 towards a direction opposite to the annular base 11, the abrasive belt supporting seat 119 is assembled with an abrasive belt mounting component 40 of the abrasive belt hand tool 100, so that the abrasive belt 30 is assembled with the abrasive belt mounting component 40 to be arranged on the protective cover 10. In another embodiment, the annular base 11 includes a retaining wall 110 located on one side opposite to the abrasive belt supporting seat 119, and the retaining wall 110 prevents debris carried by the abrasive belt 30 from being ejected toward the user during operation.

What is claimed is:

1. A protective cover assembled on an abrasive belt hand tool, the protective cover assembled with a driving component of the abrasive belt hand tool and provided for an abrasive belt to move therein, the driving component provided with a driving shaft and a protective cover mounting portion formed at one end of the driving shaft, the protective cover comprising:

an annular base, arranged on the protective cover mounting portion and provided for the driving shaft to extend into the annular base, the annular base comprising a first clamping arm and a second clamping arm facing the first clamping arm, a notch formed between the first clamping arm and the second clamping arm, the first clamping arm formed with a through hole, the second clamping arm formed with an assembly hole on a same extension line as the through hole, the assembly hole not penetrating through the second clamping arm, wherein a length of the assembly hole is longer than a length of the through hole, and an inner wall of the assembly hole is formed with a thread for assembling a threading section; and a tightening component, comprising a pull rod and a piece assembled with the pull rod, wherein the pull rod comprises a first end penetrating through the through hole and fixed in the assembly hole to pass through the notch, and a second end exposed on a surface of the first clamping arm, and wherein the piece is arranged on the surface of the first clamping arm, and wherein the pull rod is divided into a coupling section configured to be assembled with the piece, a connecting section extending from the coupling section and penetrating through the through hole, and the threading section extending from the connecting section and fixed in the assembly hole, and wherein the piece comprises a cam portion assembled with the second end of the pull rod and a shifting portion extended from the cam portion, and wherein an assembling position of the cam portion of the piece and the second end of the pull rod is deviated from a center of the cam portion, and the piece is configured to rotate with respect to a surface of the annular base by taking the assembling position as an axial center;

wherein the annular base has a first state for tightening the protective cover mounting portion when the piece is forced to rotated toward the surface of the first clamping arm, in the first state, the second clamping arm is pulled by the first end of the pull rod and moved towards the first clamping arm to narrow the notch, the protective cover is fixed to the protective cover mounting portion in the first state; and wherein the annular based has a second state for releasing the protective cover mounting portion when the piece is forced to rotated opposite to the surface of the first clamping arm, in the second state, the second clamping arm is moved opposite to the first clamping arm to broaden the notch, the protective cover is disengaged with respect to the protective cover mounting portion in the second state.

2. The protective cover assembled on an abrasive belt hand tool as claimed in claim 1, wherein the annular base comprises an abrasive belt supporting seat extending from the second clamping arm towards a direction opposite to the annular base.

3. The protective cover assembled on an abrasive belt hand tool as claimed in claim 1, wherein the protective cover comprises an arc-shaped receiving groove arranged on the first clamping arm and facing the piece.

4. The protective cover assembled on an abrasive belt hand tool as claimed in claim 1, wherein the annular base comprises an abrasive belt supporting seat extending from the second clamping arm towards a direction opposite to the annular base.

* * * * *